US010131514B2

(12) United States Patent
Shimizu

(10) Patent No.: US 10,131,514 B2
(45) Date of Patent: Nov. 20, 2018

(54) SUPPORT MECHANISM FOR PROCESSING UNIT IN SHEET PROCESSING DEVICE

(71) Applicant: Tatsuya Shimizu, Yamanashi-ken (JP)

(72) Inventor: Tatsuya Shimizu, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 14/993,648

(22) Filed: Jan. 12, 2016

(65) Prior Publication Data

US 2016/0200543 A1 Jul. 14, 2016

(30) Foreign Application Priority Data

Jan. 14, 2015 (JP) ..... 2015-005164

(51) Int. Cl.

| | |
|---|---|
| ***B42C 11/00*** | (2006.01) |
| ***B65H 37/04*** | (2006.01) |
| ***B65H 43/00*** | (2006.01) |
| ***B65H 31/02*** | (2006.01) |
| ***B65H 31/20*** | (2006.01) |
| ***B65H 31/30*** | (2006.01) |
| ***B65H 31/38*** | (2006.01) |

(52) U.S. Cl.

CPC ..... *B65H 37/04* (2013.01); *B65H 31/02* (2013.01); *B65H 31/20* (2013.01); *B65H 31/3081* (2013.01); *B65H 31/38* (2013.01); *B65H 43/00* (2013.01); *B65H 2301/4212* (2013.01); *B65H 2301/4213* (2013.01); *B65H 2403/41* (2013.01); *B65H 2403/513* (2013.01); *B65H 2405/11151* (2013.01); *B65H 2408/1222* (2013.01); *B65H 2801/27* (2013.01)

(58) Field of Classification Search

CPC .. B42C 9/00; B42C 11/00; B42C 5/00; B42B 5/00; B42B 5/08

USPC ..... 412/9, 18, 25, 33, 38

See application file for complete search history.

(56) References Cited

U.S. PATENT DOCUMENTS

2012/0018944 A1* 1/2012 Shiraishi ..... B42C 1/12 270/58.09

FOREIGN PATENT DOCUMENTS

| | | |
|---|---|---|
| JP | H06-122291 A | 5/1994 |
| JP | 2013-159415 A | 8/2013 |

* cited by examiner

*Primary Examiner* — Justin V Lewis
(74) *Attorney, Agent, or Firm* — Manabu Kanesaka

(57) ABSTRACT

The present invention is to provide a processing unit which can move smoothly to accurate position in a proper posture. The processing unit is provided with a support mechanism that supports a processing unit 26 so as to allow the processing unit 26 to be moved to a sheet processing position (processing tray) 24. The support mechanism includes the processing unit 26 and first and second support portions 50 and 55 that support the processing unit 26. The first and second support portions 50 and 55 apply, to different positions (j and k) of the processing unit 26 which are spaced from each other, a support force Fa acting from below to above (in a direction opposite to a gravity acting direction) and a support force Fb acting from above to below (in a direction same as the gravity acting direction), respectively.

7 Claims, 8 Drawing Sheets

SUPPORT MECHANISM FOR PROCESSING UNIT IN SHEET PROCESSING DEVICE

RELATED APPLICATIONS

The present application is based on, and claims priority from, Japanese Application No. 2015-005164 filed Jan. 14, 2015, the disclosure of which is hereby incorporated by reference herein in its entirety.

BACKGROUND OF THE INVENTION

Field of the Invention

The present invention relates to a support mechanism for a processing unit in a sheet processing device such as an image forming device, a bookbinding device, or the like.

Description of the Related Art

As a processing unit that applies processing to a sheet or a sheet bundle in a sheet processing device such as an image forming device, a bookbinding device, or the like, various types such as a stapler unit, a stapleless binding unit, a stamp unit, a punch unit, and sheet folding unit are known.

There occurs a necessity of changing a processing position in such types of processing units. For example, the staple unit has a mechanism for driving the processing unit to a designated processing position in order to cope with a case where the sheet bundle is bound at corners thereof and a case where it is bound at a plurality of positions (two or three positions) in a center thereof.

For example, Patent Document 1 discloses a post-processing device (finisher) that accumulates sheets fed from an image forming device in a processing tray and binds them by means of a stapler unit. The stapler unit is constituted by a drive unit such as a motor, a drive cam mechanism, a head mechanism part, an anvil mechanism part, and a staple cartridge, and the entire unit is configured to be movable in a sheet width direction along a guide rail.

Patent Document 2 discloses a mechanism that moves a stapler unit to a corner binding position and a multi-binding position. A stapler unit is movably supported by a support frame in a width direction of sheets on a tray. The support has a guide groove, along which the stapler unit is moved to the corner binding position and the multi-binding position. When the binding is performed at the sheet corner, the stapler unit is changed in orientation by a predetermined angle (e.g., 45 degrees); while when the binding is performed at the multi-binding position around a sheet center, the stapler unit is moved along a sheet end edge.

The Patent Document 2 does not disclose a mount mechanism that movably supports the stapler unit in the sheet width direction but discloses a cam groove and a drive mechanism (drive pulley/wire mechanism) that control the angle posture of the stapler unit that moves along the support mechanism.

PRIOR ART DOCUMENT

Patent Document

[Patent Document 1] Japanese Patent Application Publication No. 2013-159415 (FIG. 2)

[Patent Document 2] Japanese Patent Application Publication No. H06-122291 (FIG. 5)

As described above, the mechanism that moves the processing unit to a plurality of processing positions set for the sheet or moves the same in accordance with a sheet size is known. For example, Patent Document 1 discloses a configuration in which a position moving mechanism that moves the processing unit in the sheet width direction and a deflection mechanism (detailed structure thereof is not disclosed) of a unit angle posture, and Patent Document 2 discloses a cam groove mechanism that regulates the unit angle posture.

However, when the position of the processing unit is moved along a guide mechanism such as a rail, the processing unit may undergo backlash. To move the position of a heavy member without backlash is difficult due to smoothness of the movement thereof and a load torque, and a clearance needs to be provided between the guide mechanism and the processing unit. In this case, a larger clearance is required for a guide mechanism that can guide the processing unit while changing the unit angle posture.

The clearance may cause backlash of a support mechanism, resulting in fluctuation of a unit centroid position. Further, when an external force unexpectedly acts on the processing unit, a deviation (biting phenomenon; state illustrated in FIG. 8B of the present specification) may occur in an engagement portion between the guide surface and the processing unit, hindering smooth movement of the unit.

In the conventional approach, component accuracy is improved or a slide mechanism such as a sliding roller is employed so as to minimize the clearance for the guide mechanism; however, this inevitably causes an increase in size and cost of a unit mechanism part.

SUMMARY OF THE INVENTION

An object of the present invention is to provide a position moving mechanism capable of smoothly moving the processing unit and accurately positioning the processing unit in a proper posture.

To achieve the above object, in the present invention, in a support mechanism that supports a processing unit provided in a sheet processing device so as to allow the processing unit to be moved to a processing section, the mechanism comprising: the processing unit, a first support portion that supports the processing unit and applies a support force acting from below to above to the processing unit; and a second support portion that supports the processing unit and applies a support force acting from above to below to the processing unit, wherein a position where the first support portion applies a support force acting from below to above is different from a position where the second support portion applies a support force acting from above to below.

Thus, the processing unit can be supported by a balance between an upward support force and a downward support force with a predetermined clearance provided between the processing unit and other mechanisms such as a guide member for movably guiding the processing unit, thereby preventing occurrence of backlash in a motion of the unit and achieving a stable motion of the unit. The "upward support force" refers to a force acting in a direction opposite to the gravity acting direction, and "downward support force" refers to a force acting in the same direction as the gravity acting direction. The upward support and the downward support may each be disposed at one location or two or more locations.

More specifically, there is provided a support mechanism that supports a processing unit B (26) provided in a sheet processing device so as to allow the processing unit B (26) to be moved to a processing section. The mechanism includes the processing unit; and first and second support portions 50 and 55 that support the processing unit. The first and second support portions apply, to different positions of the processing unit which are spaced from each other, a support force Fa acting from below to above and a support force Fb acting from above to below, respectively.

According to the present invention, in a support mechanism that supports a processing unit so as to allow the processing unit to be moved in a predetermined direction, upward and downward support forces with respect to the processing unit are disposed with a predetermined interval. Thus, the following advantages are obtained.

The upward and downward support forces act on the processing unit at different portions spaced apart from each other, so that it is possible to reduce backlash by the working of weight of the processing unit.

For example, by making an upward support force (resistance force in an antigravity direction) act between a gravity center position on which a weight of the processing unit acts and a downward support force (support force in a gravity direction), forces are balanced to allow smooth motion of the processing unit.

BRIEF DESCRIPTION OF THE DRAWINGS

FIGS. 8A and 8B are explanatory views each illustrating a relationship among forces in the processing unit support mechanism, in which FIG. 8A illustrates a balanced state (normal operation state) and FIG. 8B illustrates an unbalanced state (malfunction state).

DESCRIPTION OF THE PREFERRED EMBODIMENTS

Figure 1:
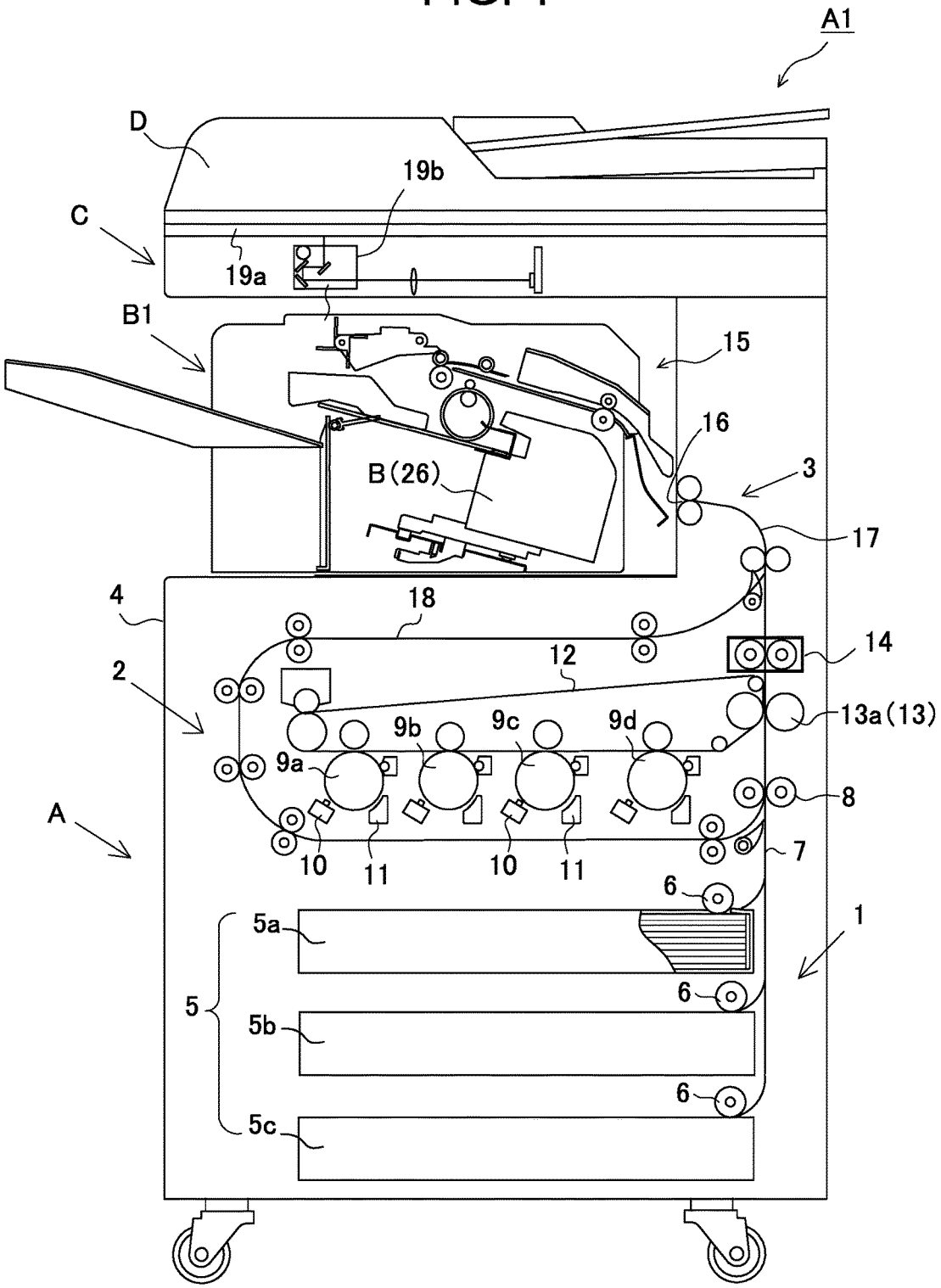
FIG. 1 is an explanatory view of an entire configuration of an image forming system provided with a support structure for a processing unit according to the present invention.

Hereinafter, the present invention will be described in detail according to an illustrated preferred embodiment. The present invention relates to a support mechanism for a processing unit provided in a sheet processing device. A sheet processing device A1 generally means a device that handles a sheet (a single sheet or a sheet bundle) such as a post-processing device (finisher), a bookbinding device, or a printer. FIG. 1 illustrates an image forming device A and a post-processing device B1 disposed at a sheet discharge area 15 of the image forming device A.

The post-processing device B1 incorporates therein a processing unit B. The processing unit B is a unit that applies predetermined processing to the sheet according to device specification. As the processing unit B, various types such as a punch unit that punches file holes in the sheet, a stamp unit that stamps the sheet, a folding unit that performs sheet folding processing, and a trimming unit that trims the sheet are known. The processing unit B may be configured as a single-function unit that has any one of these functions or may be configured as a multifunction unit that has two or more of these functions. In the example of FIG. 1, a binding unit that aligns and accumulates sheets having an image formed thereon and performs staple binding or stapleless binding for the sheets is exemplified. Hereinafter, the present invention will be described with a staple binding unit 26 (stapler device) as the processing unit.

A configuration of the image forming device A of FIG. 1 will be described. The image forming device A includes a sheet supply section 1, an image forming section 2, and a sheet discharge section 3. A sheet prepared in the sheet supply section 1 is subjected to image forming processing by the image forming section 2 and is then discharged to the sheet discharge section 3. In the sheet discharge section, the post-processing device B1 provided with the processing unit B (26) is disposed. Image formation processing is performed based on image data obtained through image reading of a sheet document by a scanner unit C or data transferred from, e.g., a word processor (computer) or a server device.

The sheet supply section 1 delivers, to a sheet feed path 7, the sheet from a plurality of sheet cassettes 5*a*, 5*b*, and 5*c* by means of a sheet feeder (feed roller) 6. To this end, a separating member such as a separating claw is incorporated in each of the sheet cassettes 5*a*, 5*b*, and 5*c*. A reference numeral 8 denotes a resist roller disposed in the sheet feed path 7. The sheet fed from the sheet supply section 1 is made to wait while being subjected to skew correction by the resist roller 8.

As the image forming section 2, there are known various kinds of mechanisms that form an image on the sheet. In the example of FIG. 1, an electrostatic image forming mechanism is exemplified. This mechanism includes a plurality of photoreceptors 9 (9*a*, 9*b*, 9*c*, and 9*d*) according to color component values such as RGB. Each of the photoreceptors 9*a* to 9*d* includes a light emitter 10 and a developing device 11. The light emitter 10 is used to form an electrostatic latent image on the photoreceptors 9*a* to 9*d* based on data to be image-formed, and toner is adhered to the electrostatic latent image by the developing device 11. Toner images formed on the respective photoreceptors 9*a* to 9*d* are transferred to a transfer belt 12 for image synthesis.

In sync with the image synthesis on the transfer belt 12, the sheet made to wait on the sheet feed path 7 is fed to a transfer section 13 and subjected to image transfer by a charger roller 13*a* disposed in the transfer section 13. The resultant sheet is subjected to fixing by a fixing device 14 disposed downstream of the charger roller 13*a* and then fed to the sheet discharge section 3.

The sheet discharge section 3 is constituted by a conveying path that conveys the sheet from the image forming section 2 to a sheet discharge port 16 formed in a device housing 4. A reference numeral 18 denotes a duplex path that reverses the sheet fed to the sheet discharge port 16 and guides the resultant sheet to the resist roller 8 of the sheet supply section 1.

The device housing 4 incorporating the above-mentioned sheet supply section 1, the image forming section 2, and the sheet discharge section 3 has a sheet discharge area 15 connected to the sheet discharge port 16. The post-processing device B1 provided with the processing unit B (26) is provided in the sheet discharge area 15.

A reference symbol C denotes a scanner unit. The scanner unit C reads an image on the sheet placed on a platen 19*a* by means of an image reading section 19*b* and transmits read data to the image forming device A. A reference symbol D denotes a document feeder equipped with the scanner unit C.

[Post-Processing Device]

The following describes the post-processing device B1 that applies post-processing to the sheet fed from the image forming device A. The processing unit B (26) is mounted to a processing section (processing tray 24 to be described later) of the post-processing device B1. The processing unit B (26) is supported so as to be movable to a plurality of processing positions.

Figure 2:
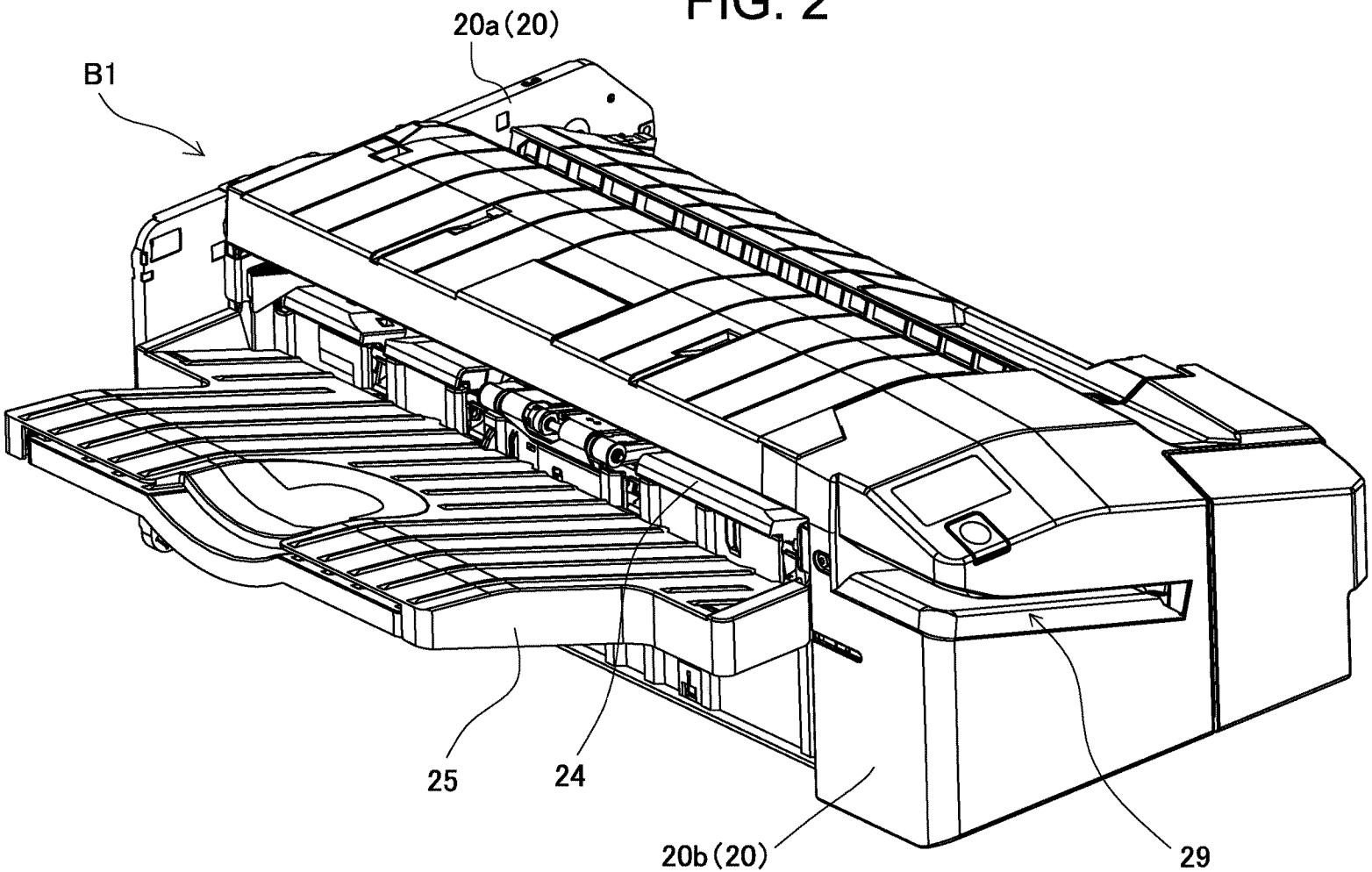
FIG. 2 is an explanatory view illustrating an outer shape of a post-processing device in the image forming system of FIG. 1.
Figure 3:
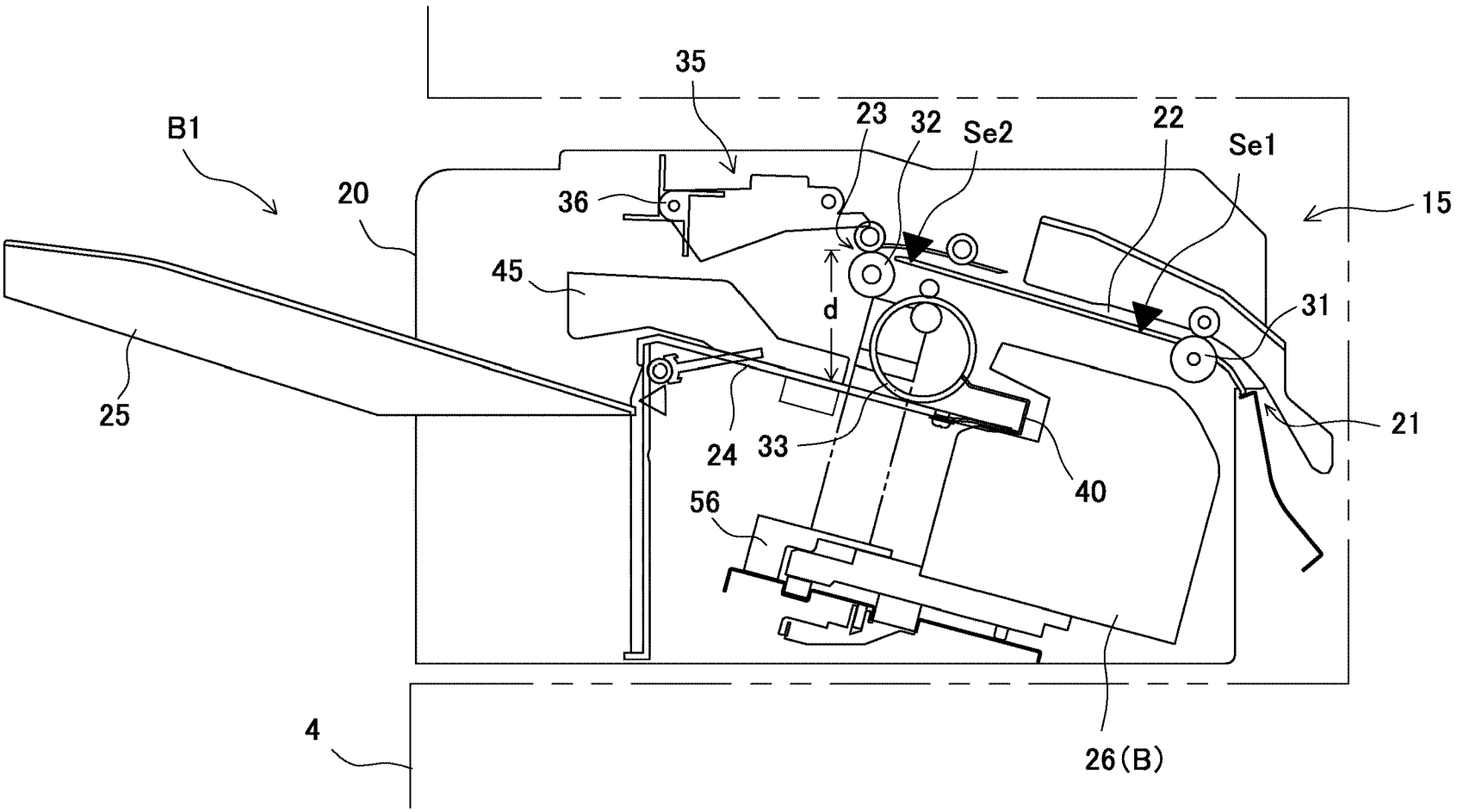
FIG. 3 is an explanatory view of an entire configuration of the post-processing device.

FIG. 2 is a perspective view of the post-processing device B1, and FIG. 3 is a cross-sectional view thereof. As illustrated in FIG. 2, the device housing 20 includes a device frame 20*a* and an outer casing 20*b*. The outer casing 20*b* is provided with a stack tray 25 and a manual setting section 29 (manual binding section). Further, a processing tray 24 is disposed upstream of the stack tray 25. Further, the processing unit B (stapler device 26) that applies binding processing to a sheet bundle accumulated on the processing tray 24 is mounted inside the housing so as to be movable.

As illustrated in FIG. 3, a sheet carry-in path 22 is disposed in the device housing 20. A path carry-in port 21 of the sheet carry-in path 22 is connected to the sheet discharge port 16 of the image forming device A. The processing tray 24 is disposed downstream of a path discharge port 23 of the sheet carry-in path 22 through a level difference d.

The sheet carry-in path 22 is provided with a carry-in roller 31 and a discharge roller 32 (which constitute a path conveying section) that convey the sheet. A not illustrated drive motor is connected to each of the rollers 31 and 32. The sheet carry-in path 22 is further provided with an entrance sensor Se1 that detects carry-in of the sheet and a discharge sensor Se2 that detects carry-out of the sheet.

The processing tray 24 is provided with a sheet carry-in section 35 that carries the sheet on the tray, a sheet regulating section 40 (stopper member) that makes the sheet abut against a predetermined position thereof to stop the sheet, and an aligning section 45. The sheet carry-in section 35 includes a conveying section 36 (illustrated one is a paddle rotary member) that reverses a conveying direction of the sheet fed from the path discharge port 23 to guide the sheet onto the processing tray 24 and a conveying section 33 (illustrated one is a ring-shaped belt rotary member) that makes the sheet abut against the sheet regulating section 40 for sheet alignment.

In the processing tray 24, the binding processing unit 26 that applies binding processing to an accumulated sheet bundle positionally regulated by the sheet regulating section 40 is disposed so as to be movable in a sheet width direction (depth direction of a paper surface of FIG. 2). Although not described in detail, the processing unit 26 is configured as a stapler device that binds the sheet bundle accumulated on the processing tray 24.

In the processing unit 26, a drive motor is fixed to a unit frame, and rotation of the drive motor is transmitted to a drive cam. The drive cam is connected with an operation arm member configured to be moved up and down in a sheet binding direction. This operation arm member is used to move up and down a staple head. The staple head incorporates therein a drive plate that inserts a staple needle into the sheet bundle and a bending member that bends the staple needle into a U-like shape. The staple head receives the staple needle (blank) from a cartridge 39 housing the staple needles.

Further, in the unit frame, an anvil section (not illustrated) is provided at a position opposite to the drive plate. The anvil section bends a tip end of the needle that has been inserted into the sheet bundle.

Through descending operation of the stapler head, the thus configured processing unit B (26) bends the blank needle supplied from an external cartridge into a U-like shape (perform shaping of the blank needle), inserts the resultant needle into the sheet bundle, and makes the needle abut against the anvil section to bend the needle tip, whereby the bending processing is achieved. The configuration of the staple unit is disclosed in JP H09-201780A and JP H10-249753A, and stapler devices having any configuration including those disclosed in these publications may be adopted in the present invention.

[Support Mechanism for Processing Unit]

The device frame 20*a* has a frame structure that supports mechanisms (a sheet conveying path mechanism section, a tray mechanism, a conveying mechanism, etc.). The illustrated device frame 20*a* adopts a framework structure in which a pair of opposing side frames (not illustrated) and a stay member connecting the both opposing frames and constituting a bottom frame 20*e*. The bottom frame 20*e* movably supports the processing unit 26 in the sheet width direction of the processing tray 24 (processing section). Hereinafter, the bottom frame 20*e* is referred to as a "support frame".

Figure 4:
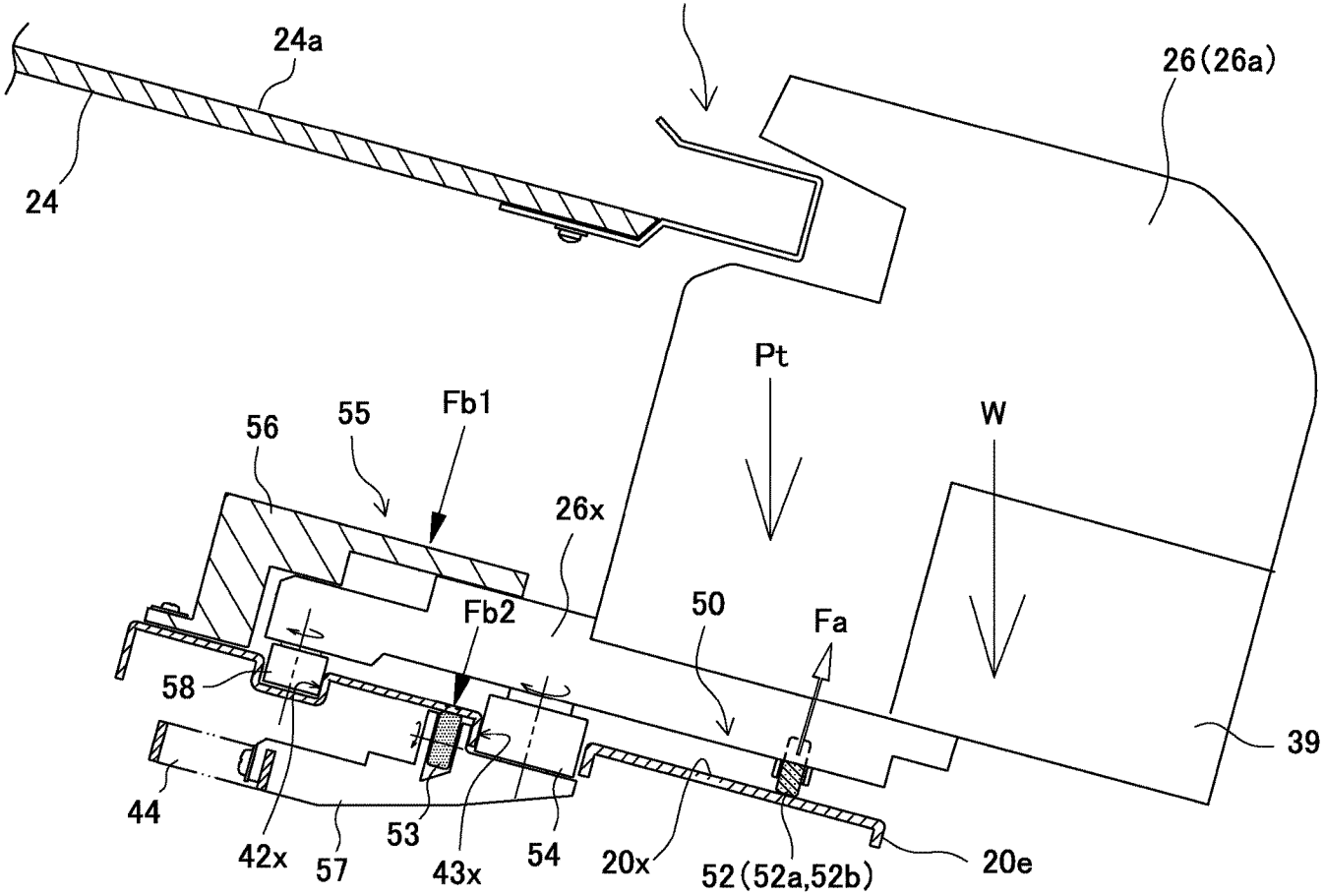
FIG. 4 is an explanatory view of the support mechanism for the processing unit, which illustrates a state where the unit is situated along a line X-X of FIG. 7.

That is, the left and right opposing side frames (not illustrated) have, at the bottom of the unit, the stay-like support frame 20*e*. As illustrated in FIG. 4 (cross-sectional view) and FIG. 7 (plan view), the support frame 20*e* has a first support portion 50 and a second support portion 55 between itself and the processing unit 26.

The processing unit 26 is constituted by a main body 26*a* having the above-mentioned configurations and a base frame 26*x* integrally formed with the main body 26*a*. The first and second support portions 50 and 55 are provided between the base frame 26*x* and the support frame 20*e* as follows.

The first support portion 50 applies a support force Fa1 to the base frame 26*x* from below to above in a direction opposite to a gravity acting direction. The support frame 20*e* has a mounting support surface 20*x*. As illustrated in FIG. 4, the mounting support surface 20*x* extends in a width direction of the sheet on the processing tray 24 and has a width L larger than a width of a maximum size of the sheet.

Figure 5:
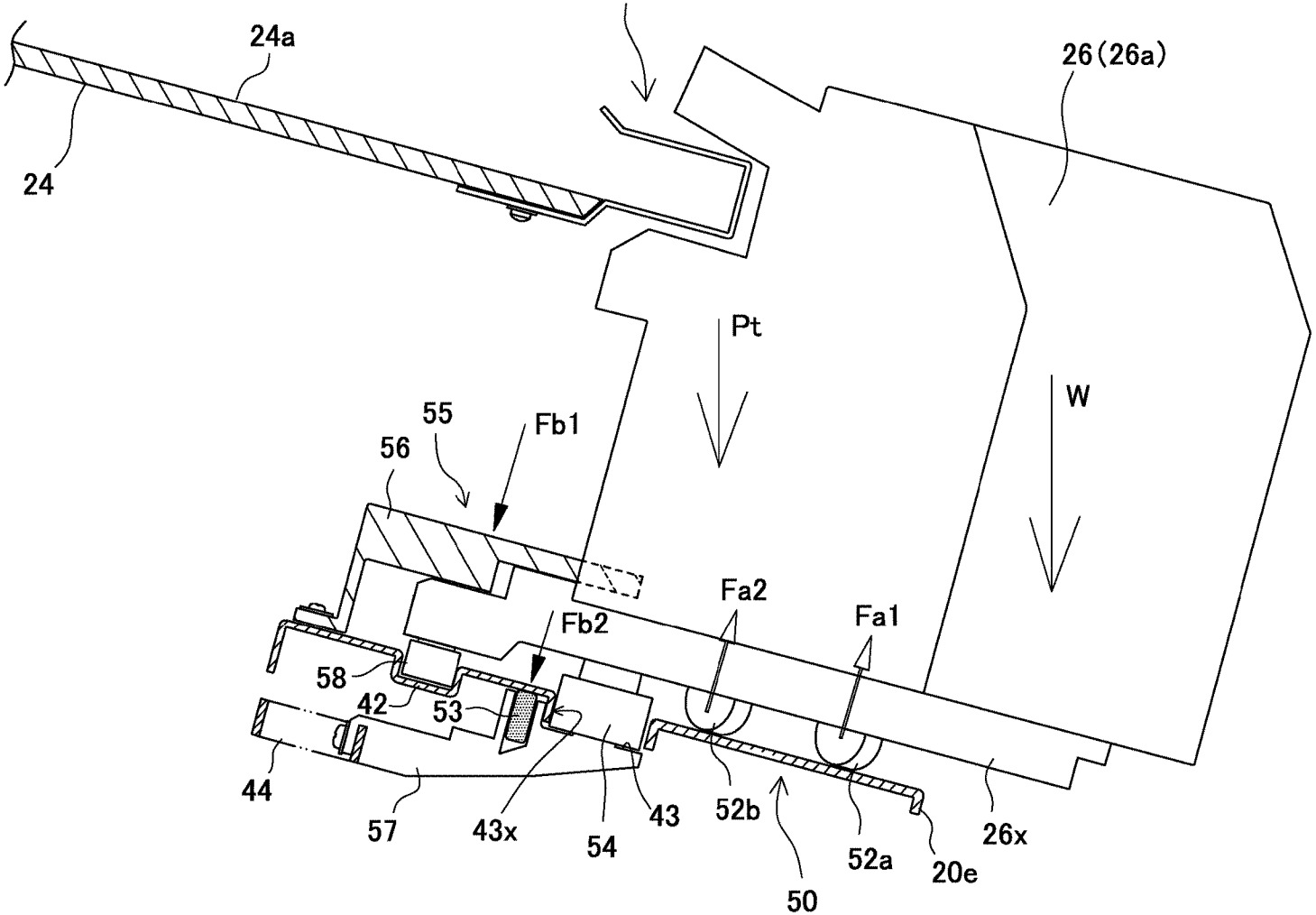
FIG. 5 is an explanatory view of the support mechanism for the processing unit, which illustrates a state where the unit is situated along a line Y-Y of FIG. 7.

As illustrated in FIGS. 4 and 5, the first support portion 50 supports the base frame 26*x* with a roller 52 (52*a* and 52*b*) mounted to the base frame 26*x* placed on the mounting support surface 20*x* of the support frame 20*e*. The illustrated roller 52 includes two roller member arranged at an interval in the sheet width direction. The mounting support surface 20*x* is formed into a flat surface that supports the roller members 52*a* and 52*b* in the same plane.

Figure 7:
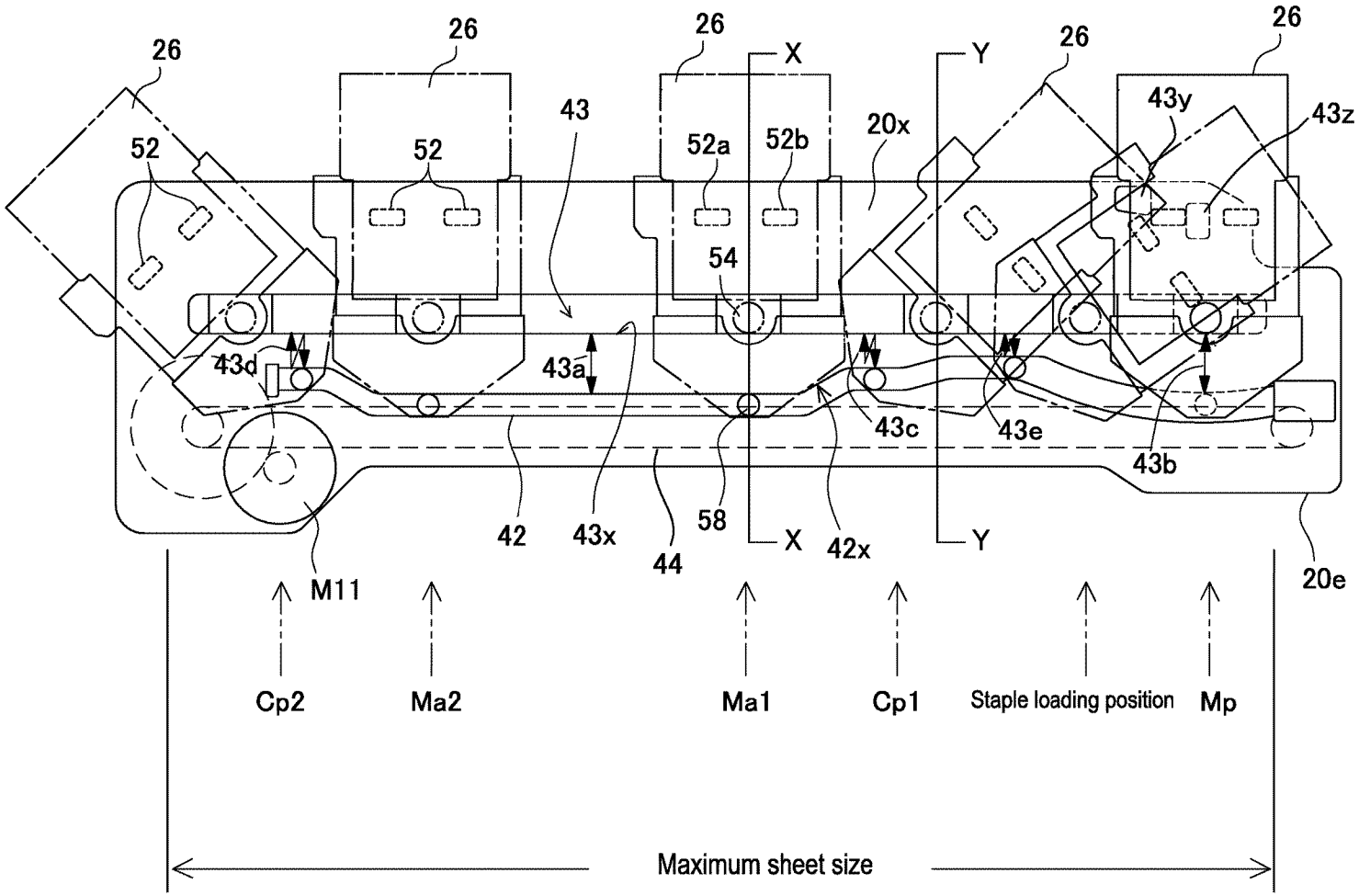
FIG. 7 is an explanatory view illustrating a position moving mechanism of the processing unit.

As illustrated in FIG. 7, the mounting support surface 20*x* is disposed so as to be movable, along a sheet binding edge (sheet rear edge, in the example of FIG. 7), to a right corner binding position Cp1, multi-binding positions Ma1 and Ma2, and a left corner binding position Cp2 in the mentioned order. The rolling roller 52 (one or two or more rollers) of the base frame 26*x* is moved along the mounting support surface 20*x*.

The processing tray 24 is inclined at a predetermined angle such that the sheet placed thereon abuts against the sheet regulating section 40 by its own weight (see FIGS. 4 and 5). The mounting support surface 20*x* is disposed in parallel with the surface of the processing tray 24 (=inclined).

In the present invention, the first support portion 50 is constituted by the mounting support surface (flat surface) 20*x*, and the rolling roller 52 is mounted to the base frame 26*x* so as to protrude therefrom, whereby the first support portion 50 and the base frame 26*x* are engaged with each other. Alternatively, a reverse configuration may be adopted. That is, the rolling roller 52 is mounted to the first support portion 50 so as to protrude therefrom and the base frame 26X is constituted by a plane to be engaged with the first support portion 50. Further, alternatively, both the first support portion 50 and the base frame 26*x* may be formed into a sliding surface (flat surface).

The second support portion 55 applies support forces Fb1 and Fb2 to the base frame 26*x* from above to below in the same direction as the gravity acting direction. In the illustrated example, the second support portion 55 is constituted by a lifting prevention roller 53 and a holding guide 56. A rolling roller 54 is integrally mounted to the base frame 26*x* by means of a bracket 57. A peripheral surface of the rolling roller 54 slides along a rear surface of the support frame 20*e*. Thus, when a tilting force (rotation moment) in an illustrated arrow x direction acts on the base frame 26*x*, the lifting of the processing unit B (26) is prevented by an engagement between the rolling roller 54 and the support frame 20*e*.

The holding guide 56 has a guide member disposed over a top plate of the base frame 26*x*, a side wall step portion (step portion in the illustrated example), and the like. The holding guide 56 is configured to press the base frame 26*x* from above to below (in the same direction as the gravity acting direction) so as to prevent the lifting of the processing unit B (26). As a result, the support forces Fb1 and Fb2 act on the base frame 26*x* in the same direction as the gravity acting direction.

As described above, the second support portion 55 makes the support force Fb act at two points (rolling roller 54 and holding guide 56); alternatively, the second support portion 55 may make the support force Fb act at any one of the two points, and the base frame 26*x* and the support frame 55 may be formed into a flat surface to be engaged with each other or may be engaged with the rolling roller 54 interposed therebetween.

Figure 8A:
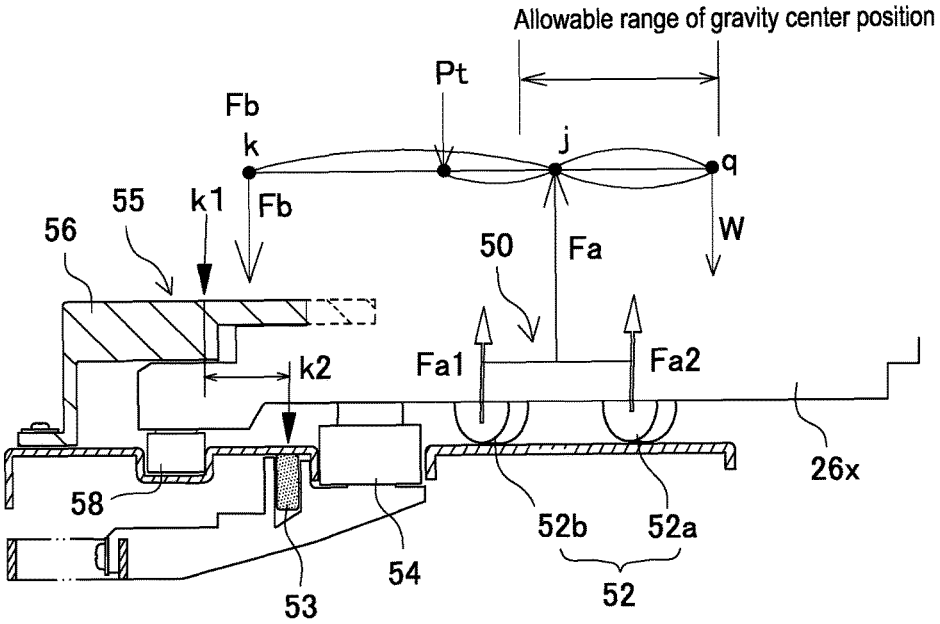

The following describes a positional relationship when a weight of the processing unit B (26) is supported by the first and second support portions 50 and 55. In terms of design philosophy, an application point (q of FIGS. 8A and 8B) of a gravity center W of the processing unit B (26), an application point (j of FIGS. 8A and 8B) of the support force Fa of the first support portion 50, and application points (k1 and k2 of FIG. 8A) of the support forces Fb1 and Fb2 of the second support portion 55 are disposed so as to balance a moment that the unit gravity center W applies and a moment that a support force (reaction force) of the second support portion 55 applies with the application point j of the first support portion 50 as a center to thereby eliminate backlash. This state is illustrated in FIG. 8A, in which a positional relationship where the application point q of the gravity center W and the application points k1 and k2 of the reaction force of the second support portion 55 are positioned on opposite sides with respect to the application point J of the first support portion 50 is retained.

The balance between the support forces is set so as to optimize an engagement state between the guide rails 42, 43 to be described later and the rolling rollers 52, 54, and 58. When the moment [W×(distance between q and j)] that the unit gravity center W applies and the moment [Fb×(distance between k and j)] of the reaction force (reaction force of the lifting force) applied to the application points k1 and k2 of the second support portion 55 are balanced with the application point j of the first support portion 50 as a center to prevent occurrence of a deviation in the processing unit 26, smooth positional movement is achieved between the guide rails 42, 43 to be described later and the rolling rollers 52, 54, and 58.

Figure 8B:
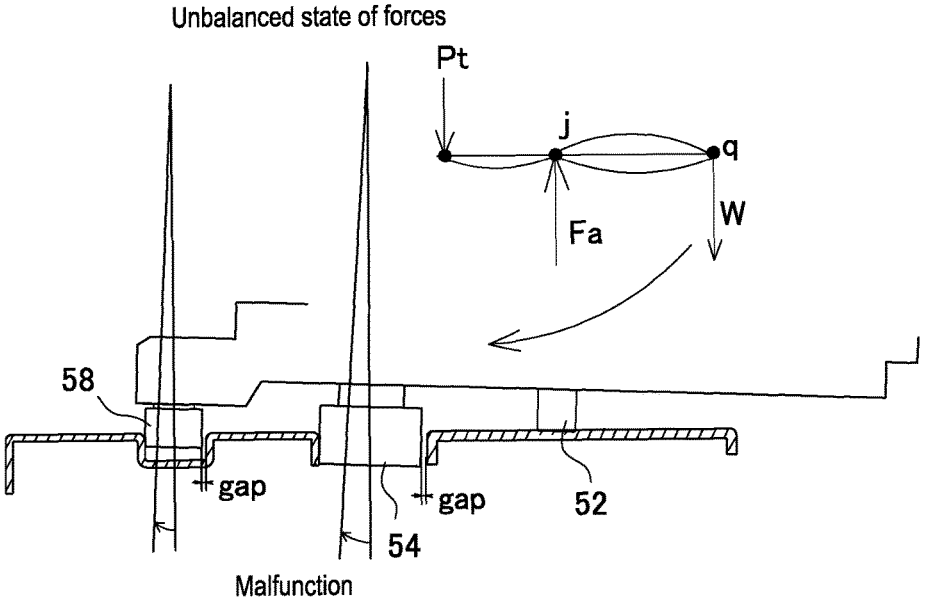

However, when the above moments become unbalanced to cause an inclination in the processing unit as illustrated in FIG. 8B, a biting phenomenon occurs between the guide rails 42, 43 and the rolling rollers 52, 54, and 58, inhibiting smooth movement. When a large clearance (gap) is formed so as to prevent the biting between the guide rails 42, 43 and the rolling rollers 52, 54, and 58, the processing unit 26 is supported by the support frame 20*e* with large backlash, preventing accurate positioning.

In the present invention, the positional relationship between the gravity center position of the processing unit B (26) and the first and second support portions 50 and 55 is not limited to the above-mentioned relationship, but the first support portion 50 and the application point (q) of the gravity center W may coincide with each other, or the application point (j of FIGS. 8A and 8B) of the first support portion 50, the application point (q) of the gravity center W, and the application point (k) of the second support portion 55 may be arranged in this order. In this case, it is necessary to generate a force relationship that compensates an eccentric moment between the guide rails 42, 43 and the rolling rollers 52, 54, and 58. This force relationship is preferably obtained from experiments. FIG. 8A illustrates a position on which the gravity center acts, which has been obtained as a result of experiments.

Further, like the second support portion 55, the first support portion 50 may have a structure in which it supports the base frame 26X at a plurality of positions thereof. In this case, balance is taken into consideration with the relationship among forces (resistance force, reaction force, etc.) regarded as a synthesized force.

The processing unit 26 may receive application of a processing force at a predetermined position thereof. Specifically, the mechanisms that perform staple binding, stapleless binding, stamp processing, punch processing, folding processing, respectively, may receive an impressive force (acting force) Pt at a processing position thereof. This acting force is to be supported by the first and second support portions 50 and 55 or guide mechanism. Thus, preferably, the application point of the acting force Pt, support point j of the first support portion 50, and a load point q of the unit gravity center are balanced left and right centering on the support point as illustrated in FIG. 8A.

[Side Aligning Section]

A side aligning section 45 (hereinafter, referred to as "side aligning member") is provided in the processing tray 24. The side aligning section 45 positions the sheet abutting against the sheet regulating section 40 in a direction perpendicular to the sheet discharge direction (sheet width direction).

A configuration of the side aligning member 45 differs depending on whether sheets having different sizes on the processing tray are aligned with a center of the sheet as a reference or with one end thereof as a reference. In the configuration illustrated in the example of FIG. 6, sheets having different sizes are discharged from the path discharge port 23 with a center of the sheet as a reference, and the discharged sheets are aligned on the processing tray with a center of the sheet as a reference. Then, a position of the sheet bundle that has been aligned with a center of the sheet as a reference is changed in accordance with the binding processing type. Specifically, when the multi-binding is performed, the sheet bundle is moved to the multi-biding positions Ma1 and Ma2 in an aligned state; when the left or right corner binding is performed, the sheet bundle is offset by a predetermined amount in the left-right direction to the binding position Cp1 or Cp2, followed by binding processing with the stapler device 26.

The side aligning member 45 has a pair of left and right opposing side aligning members 46 (46F, 46R) each protruding upward from a sheet placement surface 24*a* of the processing tray and having a regulating surface 46*x* engaged with a side edge of the sheet. The pair of left and right side aligning members 46 are disposed on the processing tray 24 so as to be reciprocated at a predetermined stroke. This stroke is set by a difference in size between maximum and minimum size sheets and an offset amount by which aligned sheet bundle is moved (offset conveyed) in the left or right direction.

Figure 6:
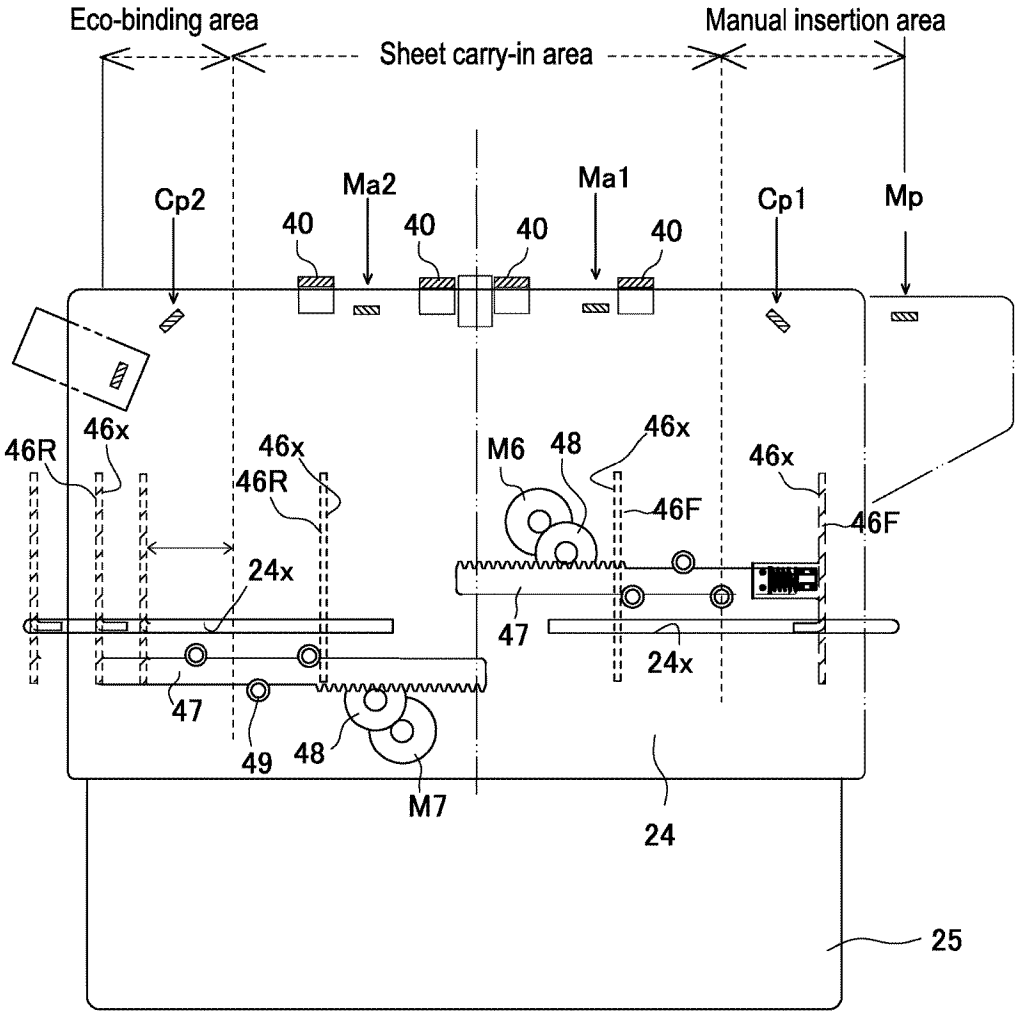
FIG. 6 is an explanatory view illustrating a plane configuration of a processing section (processing tray) in the post-processing device.

As illustrated in FIG. 6, the side aligning members 46 include a right side aligning member 46F (device front side) and a left side aligning member 46R (device rear side). The left and right side aligning members 46R and 46F each have the regulating surface 46*x* to be engaged with the sheet side edge, and the regulating surfaces 46*x* are supported by a tray member so as to be movable in mutually approaching and separating directions. Slit grooves 24*x* that penetrates the processing tray 24 are formed in the processing tray 24. Along the slit grooves 24*x*, the left and right side aligning members 46R and 46F each having the regulating surface 46*x* to be engaged with the sheet side edge can be slid.

The left and right side aligning members 46R and 46F are supported so as to be slidable by means of a plurality of guide rollers 49 (or a rail member) on a tray rear surface side. Further, racks 47 are integrally formed with the respective left and right side aligning members 46R and 46F. Aligning motors M6 and M7 are connected to the respective left and right racks 47 through a pinion 48. The left and right aligning motors M6 and M7 are each constituted by a stepping motor. A not illustrated position sensor is used to detect positions of the left and right side aligning members 46R and 46F, and the left and right side aligning members 46R and 46F can be moved in both the left and right directions by a predetermined amount based on a detection value from the position sensor.

The above aligning member moving mechanism can be achieved by a configuration other than the illustrated rack and pinion mechanism. For example, the left and right side aligning members 46R and 46F may be fixed to a timing belt which is connected to a motor reciprocating the belt in the left-right direction by a pulley.

In the above configuration, a controller (not illustrated) makes the left and right side aligning members 46R and 46F wait at a predetermined waiting position (sheet width+$\alpha$) based on sheet size information provided from the image forming device A. In this state, the sheets are carried onto the processing tray, and aligning operation is started at a timing at which the sheet end abuts against the sheet regulating section 40. In the aligning operation, the left and right aligning motors M6 and M7 are rotated in opposite directions (mutually approaching direction) by the same amount. Then, the sheets that have been carried onto the processing tray 24 are positioned with the sheet center as a reference and stacked in a bundle. By repeating the carrying-in operation and aligning operation, the sheets are aligned and accumulated on the processing tray in a bundle. At this time, the sheets having different sizes are positioned with the sheet center as a reference.

The sheets that have been accumulated on the processing tray with the sheet center as a reference are subjected to binding (multi-binding), in this posture, at a plurality of positions (of the sheet rear edge or sheet front edge) spaced apart from each other at a predetermined interval. When the binding is performed at the sheet corner, one of the left and right side aligning members 46R and 46F is moved to a position where the sheet side edge is set to a designated binding position.

Then, the other one of the side aligning members is moved in the approaching direction. A movement amount in the approaching direction is calculated based on the sheet size. As a result, the sheets that have been carried onto the processing tray 24 are aligned such that the right side edge thereof coincides with the binding position for the right corner binding and that the left side edge thereof coincides with the binding position for the left corner binding.

[Position Moving Mechanism of Processing Unit]

As described above, the processing unit 26 is supported by the first and second support portions 50 and 55, and the first and second support portions 50 and 55 are disposed so as to be movable according to the sheet processing position. The following describes a position moving mechanism of the processing unit 26. The support frame 20*e* is provided with a guide section and a drive section that move the processing unit 26 in a predetermined posture.

A traveling guide rail 42 (hereinafter, referred to merely as "guide rail") and a slide cam 43 are disposed on the support frame 20*e*. The guide rail 42 has a traveling rail surface 42*x*, and the slide cam 43 has a traveling cam surface 43*x*. A combination of the traveling rail surface 42*x* and the traveling cam surface 43*x* can support the processing unit 26 so as to allow the processing unit 26 to be reciprocated at a predetermined stroke, as well as, can control the unit angle posture.

The rail surface 42*x* and the cam surface 43*x* of the traveling guide rail 42 and the slide cam 43 are formed so as to allow the processing unit 26 to be reciprocated within a moving range thereof (including a sheet carry-in area, a manual insertion area, and an eco-binding area). The traveling guide rail 42 is formed of a rail member having a stroke along a rear end regulating member 41 of the processing tray 24. In the illustrated example, the traveling guide rail 42 is constituted by an opening groove formed in the support frame 20*e*.

The traveling rail surface 42*x* is formed along the opening groove and disposed in parallel to the rear end regulating member 41 of the processing tray at its straight line part. The slide cam 43 is disposed spaced apart from the traveling rail surface. In the illustrated example, the slide cam 43 is constituted by a groove cam formed in the support frame 20*e*. The traveling cam surface 43*x* is formed along the groove cam.

The moving unit 26 (processing unit) is fixed to a traveling belt 44 connected to a drive motor (traveling motor) M11. The traveling belt 44 is wound around a par of pulleys rotatably supported by the support frame 20*e*, and the drive motor is connected to one of the pulleys. Thus, the processing unit 26 is reciprocated at a predetermined stroke by normal/reverse rotation of the traveling motor M11.

There are formed, between the traveling rail surface and the traveling cam surface, parallel interval portions (span G1) 43*a* and 43*b*, narrow swinging interval portions (span G2) 43*c* and 43*d*, and a narrower swinging interval portion (span G3) 43*e* (span G1>span G2>span G3). In the span G1, the unit is parallel to the sheet rear edge. In the span G2, the unit is inclined to the left or right. In the span G3, the unit is inclined more (to the right in the drawing).

The structure of the traveling guide rail 42 is not limited to the opening groove structure, but a guide rod, a projection rib, and other various structures may be adopted. Further, the structure of the slide cam 43 is not limited to the cam groove, but various structures, such as a projection rib member, that have a cam surface for guiding the processing unit 26 in a predetermined stroke direction may be adopted.

The processing unit 26 is engaged with the traveling guide rail 42 and the slide cam 43 as follows. As illustrated in FIG. 7, the moving unit 26 is provided with a first rolling roller 58 (rail fitting member) to be engaged with the traveling rail surface 42*x* and a second rolling roller 54 (cam follower member) to be engaged with the traveling cam surface 43*x*. In addition, the processing unit 26 is provided with a siding roller 52 (two ball-shaped sliding rollers 52*a* and 52*b* in the illustrated example) to be engaged with a support surface of the support frame 20*e*. Further, the processing unit 26 is provided with a guide roller 53 to be engaged with a bottom surface of the bottom frame to thereby prevent lifting of the processing unit 26 from the bottom frame.

With the above configuration, the processing unit 26 is movably supported by the support frame 20*e* through the rolling rollers 52*a* and 52*b* and the guide roller 53. The first rolling roller 58 and the second rolling roller 54 are rotated along the respective traveling rail surface 42*x* and the traveling cam surface 43*x* to travel therealong.

What is claimed is:

1. A processing apparatus comprising:

a moving portion that is movable in a predetermined direction and includes a processing-unit that processes a sheet, a first portion moving along with the processing unit in the predetermined direction, and a second portion moving along with the processing unit in the predetermined direction;

a first support portion that contacts directly the first portion and applies a support force acting from below to above to the first portion; and a second support portion that contacts directly the second portion and applies a support force acting from above to below to the second portion, wherein in a direction orthogonal to the predetermined direction and in a horizontal direction, a first position where the first support portion applies a support force acting from below to above to the first portion is positioned between a gravity center position of the processing unit and a second position where the second support portion applies a support force acting from above to below to the second portion, and wherein there is no contact portion which contacts directly the moving portion at a position opposite to the second position across the gravity center position in the direction orthogonal to the predetermined direction and in the horizontal direction and applies a support force acting from below to above to the moving portion.

2. The sheet processing apparatus according to claim 1, wherein the first portion is disposed at a bottom portion of the moving portion, the first support portion is constituted by a contact surface to be contacted with the first portion, the second support portion is constituted by a contact surface to be contacted with the second portion, and the contact surfaces are extending in the predetermined direction.

3. The sheet processing apparatus according to claim 1, wherein one of the first and second support portions is disposed on one side with respect to a processing position of the moving portion, and the other one of the first and second support portions is disposed on the other side with respect to the processing position.

4. The sheet processing apparatus according to claim 1, wherein at least one of the first portion and second portion is formed from a rolling roller.

5. The sheet processing apparatus according to claim 1, further comprising:

a guide section that moves the moving portion at a predetermined stroke.

6. The sheet processing apparatus according to claim 5, wherein the guide section is a guide member that is disposed in the predetermined direction and has a guide area that moves the moving portion in a predetermined posture and a guide area that changes an angle posture of the moving portion.

7. The sheet processing apparatus according to claim 1, wherein the processing unit binds a sheet bundle set on a sheet processing-tray.

* * * * *